US005918645A

United States Patent [19]

Froment et al.

[11] Patent Number: 5,918,645

[45] Date of Patent: Jul. 6, 1999

[54] CATCH CONFIGURATIONS FOR THE PIVOT ARMS OF A ROTARY DOBBY

[75] Inventors: Jean-Paul Froment, Doussard; Jean-Pierre Pages, Faverges, both of France

[73] Assignee: Staubli Faverges, Faverges, France

[21] Appl. No.: 08/990,792

[22] Filed: Dec. 15, 1997

[30] Foreign Application Priority Data

Dec. 31, 1996 [FR] France ..... 96 16392

[51] Int. Cl.[6] ..... D03C 1/00

[52] U.S. Cl. ..... 139/66 R; 139/76; 74/567

[58] Field of Search ..... 139/66 R, 76, 139/68; 74/567

[56] References Cited

U.S. PATENT DOCUMENTS

| | | | |
|---|---|---|---|
| 4,444,225 | 4/1984 | Palau et al. | 139/66 R |
| 4,542,769 | 9/1985 | Julich | 139/66 R |
| 4,544,000 | 10/1985 | Bourgeaux . | |
| 4,646,788 | 3/1987 | Brock et al. | 139/66 R |
| 4,776,372 | 10/1988 | Surkamp | 139/76 |
| 5,335,564 | 8/1994 | Vinciguerra | 139/66 R |

FOREIGN PATENT DOCUMENTS

| | | |
|---|---|---|
| 0163585 | 4/1985 | European Pat. Off. . |
| 2540524 | 2/1983 | France . |

*Primary Examiner*—Andy Falik
*Attorney, Agent, or Firm*—Dowell & Dowell, P.C.

[57] ABSTRACT

A rotary dobby which includes pivoting arms which are moveable with respect to a plate connected to an element for actuating a heddle frame in controlled response to a reading-in device and wherein the pivot arms include catches which are uniquely configured having internal and external bearing surfaces which cooperatively engage binding surfaces of the plate.

7 Claims, 3 Drawing Sheets

100
6
6a
5
4
17
19
20
9
8
8a
7a
10
2
1
3
7
18a
20
18
17
11
18
12
13
14
16
15
7a
20
14
13
12
11
4a

CATCH CONFIGURATIONS FOR THE PIVOT ARMS OF A ROTARY DOBBY

BACKGROUND OF THE INVENTION

1. Field of the Invention

This invention relates to a rotary dobby for the operation of the heddle frames installed on a loom and a weaving loom and to a loom provided with such a dobby.

2. Description of the Related Art

It is known that in rotary dobbies the vertical movement of the heddle frames is provided by oscillating components that can be constituted, depending on the case, by connecting rod-arm assemblies or by roller-bearing arms; these oscillating parts are driven by actuating elements in the form of an eccentric gear in the first case or of a cam in the second one. These actuating elements are mounted on a main shaft of the mechanism that is actuated by an intermittent rotary movement and, at the time of each stoppage, as a matter of fact at all the half turns of the above-mentioned shaft, the reading-in device must interlock the actuating element either with the shaft, in order to drive the oscillating part, or with a stationary point in order to effect the angular immobilization of the latter; this interlocking must be effected at each of heddles of the dobby, that is to say of the actuating unit associated with each heddle frame and depending on the design or weave to be obtained on the loom during the weaving process.

This selective interlocking is generally obtained by means of a cotter or catch shaped movable coupling element subjected to the action of two pivoting arms arranged on one and the other sides of the shaft in order to actuate this moveable element to its two stop positions, being each pair of pivoting arms controlled by the reading-in device of the dobby.

In patent application FR-A-2 540 524 was disclosed a rotary dobby for looms in which a plate joined to each heddle frame is comprised of two diametrically opposed notches suitable to interact with the catch of two pivoting arms that are controlled by the reading-in device. These two notches are of different shape because one of them must be relatively deep in order to provide the plate with a perfectly precise angular position and then ensure an adequate holding for as long as necessary. On the other hand, the other notch is of reduced depth and is provided with lateral walls which are wide open and that run parallel to the chamfers of the extremities of the sides of the catch of each pivoting arm, so that the arm's catch can be automatically driven with the rotation of the plate, without the actuating of the reading-in device upon the arm. In this second case, one talks about a "passive" engaging of the catch in the notch because, even if the elastic engaging takes place in the same manner in both notches, the catch of the second arm can be passively pushed back.

Tests have shown that such an arrangement functions in a satisfactory manner, but the catch of each arm must be relatively elongated because the bearing surfaces between the first and the second notches of the plate have height that are added up dimensions or cumulative in the direction of the release of the catch with respect to these notches. This means that the angular movement of each of the pivoting arms must have a relatively large amplitude in order to allow the release of the two bearing surfaces provided on each notch of these arms. The necessary power for such an angular movement is high, hence a relatively high energy consumption of the dobby in question.

Furthermore, these large-amplitude angular movements are carried out through strong impacts on the pivoting arms, which cause a premature wear and tear of the components of the dobby of known design, unless these components are of a particular strong construction. Further, these impacts are noise generators, which is an irritant as regards the operators whose work stations are in close proximity of the looms provided with the known type of dobbies.

Lastly, the pivoting of the arms is not instantaneous and the wider its amplitude the longer it takes. This is because wide amplitude pivoting of the arms is of such nature that it limits the speed of the known dobbies.

SUMMARY OF THE INVENTION

This invention has the purpose of remedying these shortcomings with the aim of facilitating the construction of a rotary dobby operating with arms that pivot with a relatively minor amplitude.

With this in mind, the present invention relates to a rotary dobby for a weaving loom that comprises at each of its shafts an oscillating element that is coupled to a heddle frame and connected to an actuating element loosely mounted on a shaft of the dobby, a moveable coupling mechanism resting on a plate that is laterally solid with an actuating element, this moveable mechanism being subjected to elastic means to effectuate the angular connection of the plate with a disk firmly attached to the shaft, and two pivoting arms subjected to the action, on one hand, of the reading-in device and, on the other hand, to the action of the elastic means that function to engage the catches of the arms with one of the two binding surfaces of the plate. This dobby is characterized by the fact that the catch of each pivoting arm has both an external and an internal bearing surface, which surfaces have vertex angles of different values.

Thanks to the present invention, the internal and external bearing surfaces can interact with each of the two binding surfaces of the plate and their arrangement allows that their height dimensions are not cumulative, so that the necessary pivoting for each arm does not have to equal what would be a cumulative height of the bearing surfaces.

In accordance with a first advantageous aspect of the present invention, the internal bearing surface is contained inside the width of the external bearing surface. Thanks to this aspect of the present invention, the height of the external bearing surface itself defines the maximum angular displacement for the catch of each arm to be released from the binding surfaces provided for at the periphery of the plate.

In accordance with a first advantageous embodiment of the present invention, the angle of the internal bearing surface is greater than the vertex of the external bearing surface. In accordance with a variant of the present invention, the angle of the internal bearing surface is smaller than the angle of the external bearing surface. In all the cases and in accordance with another advantageous aspect of the present invention, the design can be such that the two binding surfaces of the plate are provided with a notch suitable to house the catch of one of the pivoting arms and a lug suitable to enter into the catch of the other pivoting arm. This arrangement of the binding surfaces is fit for the interaction with the shape of the bearing surfaces of the catches of the pivoting arms.

Lastly, the invention relates to a loom provided with a dobby as described above.

BRIEF DESCRIPTION OF THE DRAWINGS

The invention will be better understood and its other advantages will be seen more clearly through the below description of two embodiments of a dobby in accordance with its principle, in accordance with its principle, given only by way of example and making reference to the accompanying illustrations wherein.

DESCRIPTION OF THE PREFERRED EMBODIMENT

Figure 1:
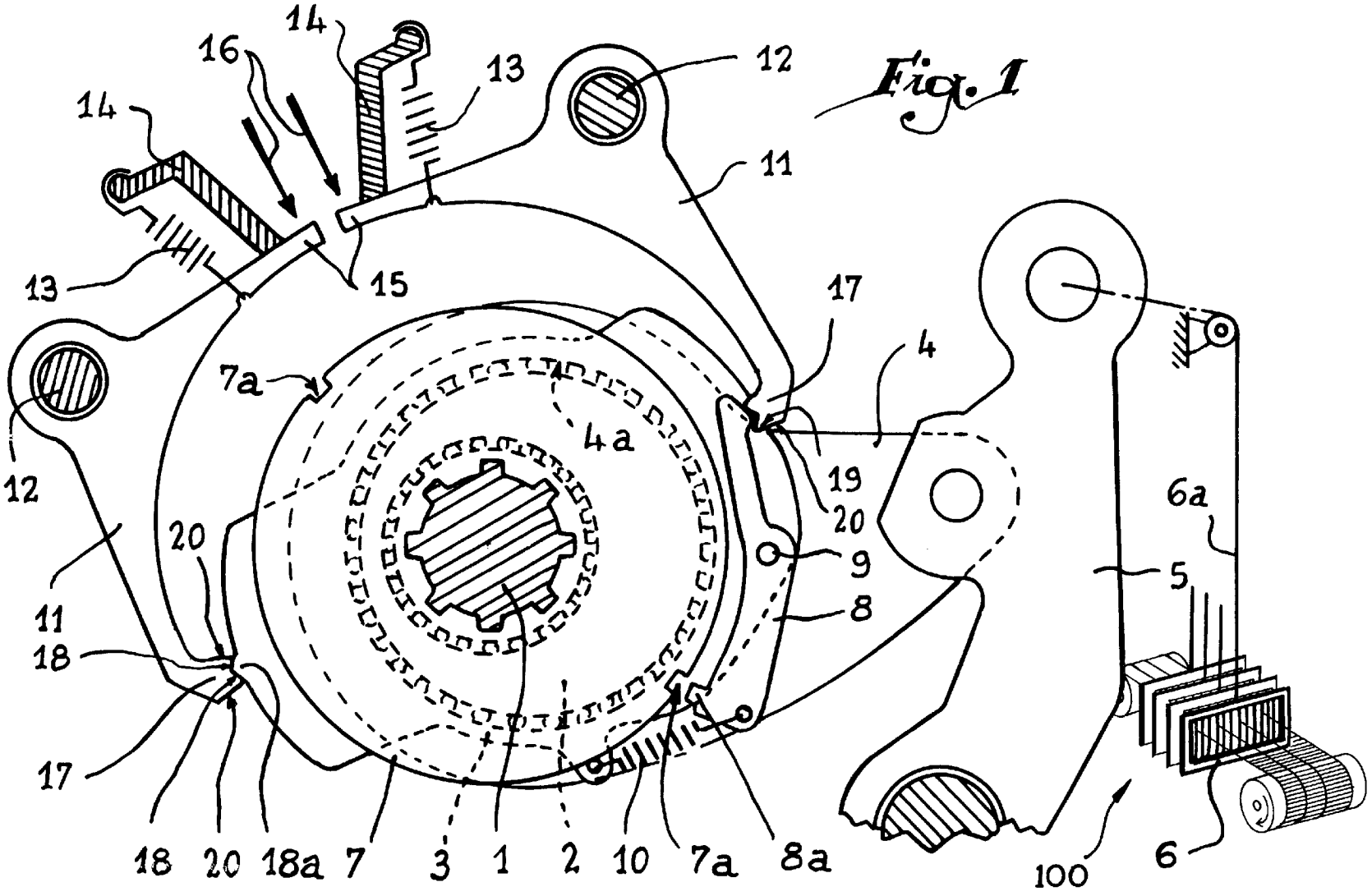
FIG. 1 shows a schematic cross section of a dobby in accordance with the present invention.
Figure 2:
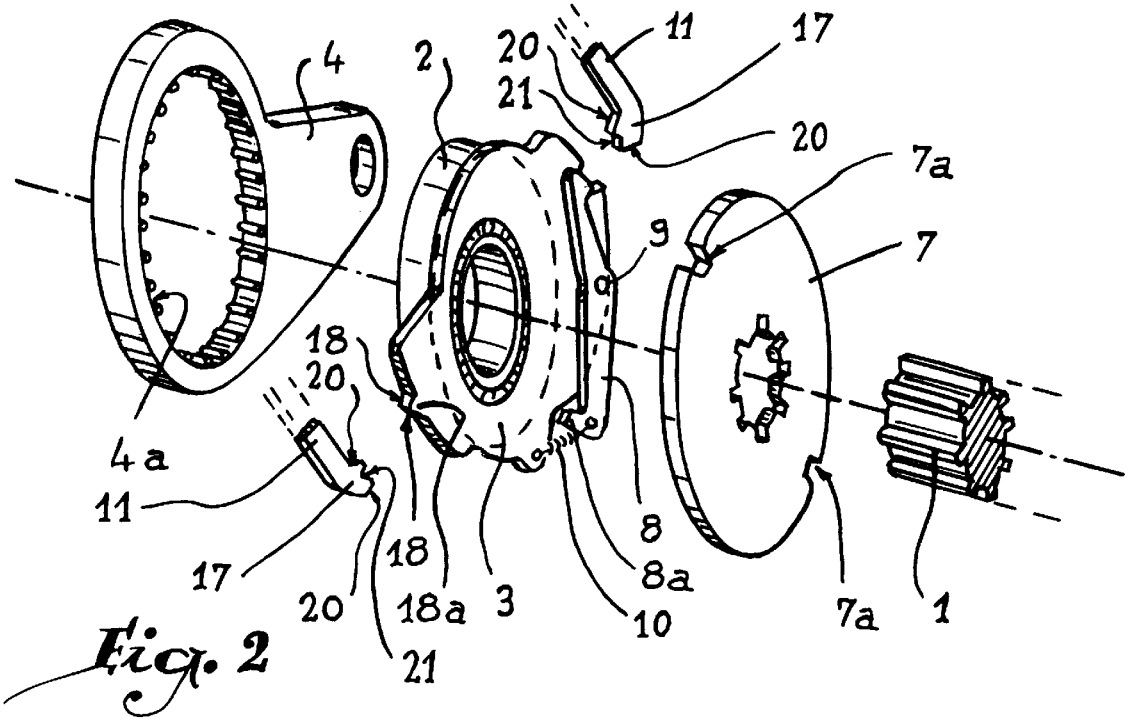
FIG. 2 is a view in perspective showing in a disassembled state the essential constituting elements of one of the heddles of the dobby in accordance with FIG. 1.

The dobby illustrated in FIG. 1 comprises a main shaft 1 driven by an intermittent rotary motion that stops at every half turn. This shaft 1 is provided with a number of bearings, which number is equal to that of the heddle frames of the loom. On each bearing is loosely mounted an eccentric gear 2 that is laterally solid with a plate 3. On each eccentric gear 2 is loosely mounted the opening 4*a* of a connecting rod 4 of which the free end is attached to a pivoting arm 5 which, thanks to a wire 6*a*, causes the vertical movement of the heddle frame 6 of the considered heald shaft, represented in a very schematic manner. Between two adjacent eccentric gears 2, the grooved shaft 1 bears a drive disk 7 that is firmly attached to it and that has on its periphery two radial notches 7*a* that are diametrically opposed to each other. These notches 7*a* are intended to selectively engage the terminal pawl 8*a* of a catch 8 linked to a spindle 9 affixed to the lateral plate 3 of the corresponding eccentric gear 2. A spring 10 continuously releases the pawl 8*a* from the catch 8 towards the shaft 1.

The control of each catch 8 is carried out by means of two pivoting arm 11 mounted to stationary spindles 12 running parallel to the shaft 1. Each arm 11, taken as a whole, presents a square profile and is acted upon by a spring 13 in order to come to rest against a corresponding stationary stop 14. Each arm 11 is provided with a drive rod 15 susceptible to be selectively controlled by a tappet or pusher belonging to the reading-in device of the dobby and represented by the arrows 16.

Opposite to its rod 15, each arm 11 is provided with a catch 17 susceptible to interact with two binding surfaces 18 and 19 arranged at the periphery of the plate 3. Thanks to the catches 17 and to the binding surfaces 18 and 19, the plate 3 can thus be immobilized in two positions separated by a 180° rotation of the plate 3 depending on whether the catch 17, shown at the left in FIG. 1, interacts with the surface 18 while the catch 17, shown at the right, interacts with the surface 19, or whether the catch 17, shown at the left, interacts with the surface 19 while the catch 17, shown at the right, interacts with the surface 18.

In the absence of an actuating of the tappet or pusher of the reading-in device, at the moment when each stop of the plate 1 is facing the catches 17, the springs 13 cause these catches to interact with the notch-shaped binding surface 19, which has the concomitant effect to angularly immobilize the plate 3, and with it the eccentric gear 2 and the connecting rod 4, and to control the catch 8 in its uncoupling by withdrawing its pawl 8*a* from the notch 7*a* into which it was engaged. This constitutes an "active" binding of the plate 3 with respect to the arm 11.

The operation is similar to the one described in FR-A-2 540 524. The positioning and the withdrawal of the catch 17 located in the proximity of the catch 8 with respect to the surface 19 must be carried out in a precise manner, subject to the control of the reading-in device. The positioning with respect to the surface 18 of the catch positioned in front of the catch 8 is transitory. It is carried out with slight force in order to allow an automatic ejection without interacting with the reading-in device.

Figure 4:
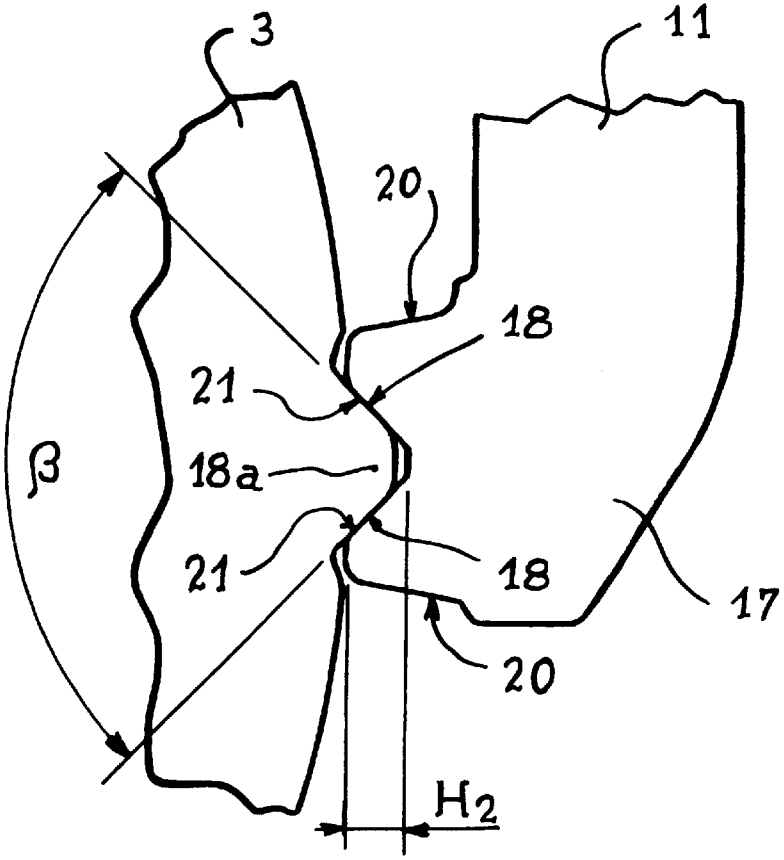
FIG. 4 is a view similar to that of FIG. 3 with an arm interacting with a portion of the plate diametrically opposed to the one illustrated in FIG. 3.
Figure 3:
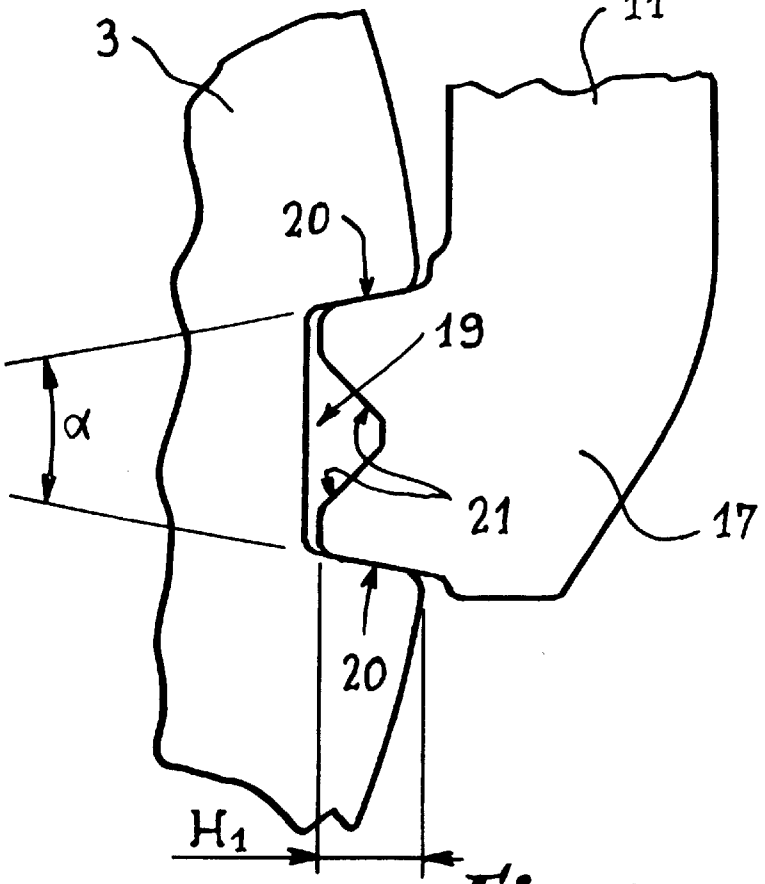
FIG. 3 shows at an enlarged scale the catch of a pivoting arm and the notch of the plate associated with one heddle in a first binding position.

In order to carry out the above enumerated functions and as it appears more clearly from FIGS. 3 and 4, the geometry of the catches, that are identical since they can selectively interact with each of the binding surfaces 18 and 19, is designed in such a manner that each of them has an external bearing surface 20 and an internal bearing surface 21, that are suitable to interact with the binding surfaces 19 and 18, respectively.

The external bearing surface 20, represented active in FIG. 3, has a geometry that is adapted to fit against the surfaces delimiting the notch 19. The vertex of this bearing surface 20 is referenced as $\alpha$. An internal bearing surface 21 is defined sunken in the catch 17 and its vertex is referenced $\beta$. The geometry of the bearing surface 21 is designed so that it is suitable to fit against the external surface of a tooth 18*a* belonging to the binding surface 18, as illustrated in FIG. 4.

In can be noted that the vertex $\beta$ is greater than the vertex $\alpha$, so that it is easier to disengage the catch 17 when it interacts with the surface 18 than when interacting with surface 19, which must be related to the operating method of the dobby in accordance with the invention, in which the binding obtained with the surface 18 is "passive" while the binding obtained with the notch 19 is "active".

The bearing surface 21 has a height $H_2$ that can be different than the height $H_1$. of the bearing surface 20. It can be noted in particular that the internal bearing surface 21 is contained inside the width of the external bearing surface 20, that is to say, the height $H_2$ is less than the height $H_1$.

Figure 5:
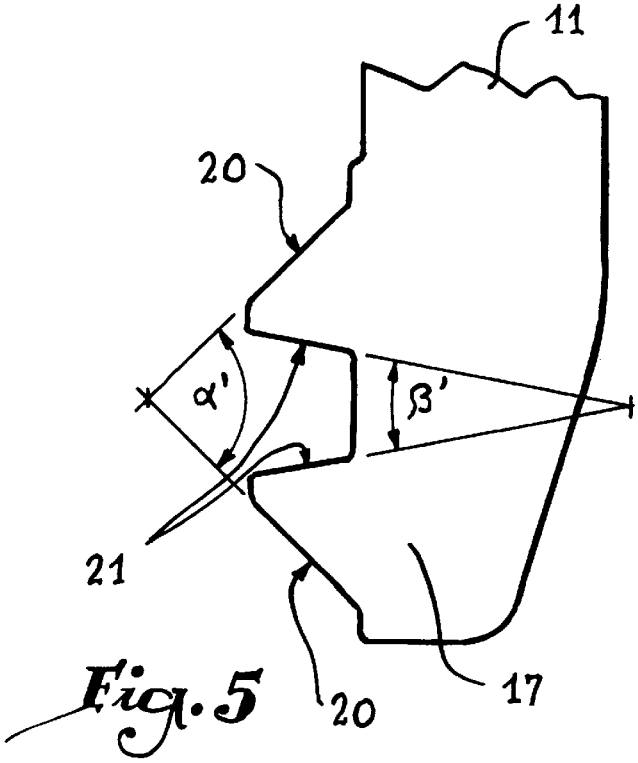
FIG. 5 is a view of the end of a pivoting arm of a rotary dobby in accordance with a second embodiment of the present invention.

In the second embodiment illustrated in FIG. 5, the value of the vertex $\beta$ of the internal bearing surface 21 is lower than that of the vertex $\alpha$ of the external bearing surface 20. This configuration can be used when an effective or "active" binding must be obtained for a tooth corresponding to the tooth 18 of FIG. 4, when the release of the bearing surface 20 must be facilitated. This configuration can be used when the binding surface provided with a tooth is in the proximity of the catch 8.

A loom provided with a dobby of above described type can operate faster with less wear and tear and makes less noise than a weaving loom provided with a dobby of previously known type.

Furthermore, it must be understood that the above description as given only by way of example and that it does not limit at all the scope of the invention, from which one would not deviate by replacing the described design details with equivalent ones. It can be especially conceived that the invention is susceptible to be used for dobbies in which the actuating elements are not constituted by eccentric gears linked to connecting rods but by cams shaped to control roller-bearing arms coupled to the heddle frames 6. In the same manner, and although the tilting catches seem to be the most advantageous design for the movable coupling elements, one can resort to mechanisms of keys or pins having a radial displacement. Also, the movable coupling element can be constituted by several components, such as, for example, two hooks, two clasps or two keys or pins.

What we claim is:

1. A rotary dobby adapted for use in controlling the movement of a heddle in a weaving loom, comprising, an oscillating element adapted to be connected to a heddle frame and linked to an actuating element mounted on a main shaft of said dobby, a movable coupling element pivoted relative to a plate laterally offset to said actuating element, said moveable coupling element being subjected to elastic means to effect an angular connection of said plate with a disk firmly attached to said main shaft, two pivoting arms each including a catch for cooperatively engaging a pair of spaced binding surfaces of said plate, elastic means for normally engaging said pivoting arms so that said catches are urged toward said binding surfaces of said plate, means responsive to a reading-in device for urging said pivoting arms to space said catches from said binding surfaces of said plate, and said catch of each pivoting arm having a pair of external bearing surfaces and a pair of internal bearing surfaces which are defined by vertex angles ($\alpha$, $\beta$, $\alpha'$ and $\beta'$) of different values.

2. A rotary dobby in accordance with claim 1, wherein said internal bearing surfaces are contained inside a width of said external bearing surfaces.

3. A rotary dobby in accordance with claim 1, wherein the vertex angle ($\beta$) of said internal bearing surfaces is greater than the vertex angle ($\alpha$) of said external bearing surfaces.

4. A rotary dobby in accordance with claim 1, the angle of the vertex ($\beta'$) of said internal bearing surfaces is lesser than that of the vertex angle ($\alpha'$) of said external bearing surfaces.

5. A rotary dobby in accordance with claim 1, wherein said two binding surfaces of said plate comprises a first notch and a first tooth with said catch of one of said pivoting arms being engageable within said first notch and said catch of the other of said pivoting arms being engageable with said first tooth.

6. A rotary dobby in accordance with claim 5, wherein said notch and said tooth are diametrically opposed to one another on a periphery of said plate.

7. A weaving loom comprising; a heddle frame, a rotary dobby including an oscillating element adapted to be connected to said heddle frame and linked to an actuating element mounted on a main shaft of said dobby, a movable coupling element pivoted relative to a plate laterally offset to said actuating element, said moveable coupling element being subjected to elastic means to effect an angular connection of said plate with a disk firmly attached to said main shaft, two pivoting arms each including a catch for cooperatively engaging a pair of spaced binding surfaces of said plate, elastic means for normally engaging said pivoting arms so that said catches are urged toward said binding surfaces of said plate, means responsive to a reading-in device for urging said pivoting arms to space said catches from said binding surfaces of said plate, and said catch of each pivoting arm having a pair of external bearing surfaces and a pair of internal bearing surfaces which are defined by vertex angles ($\alpha$, $\beta$, $\alpha'$ and $\beta'$) of different values.

* * * * *